US009771663B2

(12) United States Patent
Yu et al.

(10) Patent No.: US 9,771,663 B2
(45) Date of Patent: Sep. 26, 2017

(54) ANODIZATION SEALING PROCESS FOR AN ALUMINUM OR ALUMINUM ALLOY ELEMENT FOR VEHICLES

(71) Applicant: JIAXING MINHUI AUTOMOTIVE PARTS CO., LTD., Jiaxing, Zhejiang (CN)

(72) Inventors: Zhenyu Yu, Zhejiang (CN); Chen Xing, Zhejiang (CN); Jia Li, Zhejiang (CN); Adam Jankowski, Zhejiang (CN)

(73) Assignee: JIAXING XINGHE AUTOMOTIVE PARTS CO., LTD., Jiaxing (CN)

( * ) Notice: Subject to any disclaimer, the term of this patent is extended or adjusted under 35 U.S.C. 154(b) by 385 days.

(21) Appl. No.: 14/411,460

(22) PCT Filed: Mar. 1, 2014

(86) PCT No.: PCT/CN2014/072770
§ 371 (c)(1),
(2) Date: Dec. 26, 2014

(87) PCT Pub. No.: WO2015/021771
PCT Pub. Date: Feb. 19, 2015

(65) Prior Publication Data

US 2016/0273123 A1 Sep. 22, 2016

(30) Foreign Application Priority Data

Aug. 15, 2013 (CN) ..... 2013 1 0356141

(51) Int. Cl.
*C25D 11/00* (2006.01)
*C25D 11/18* (2006.01)
(Continued)

(52) U.S. Cl.
CPC ..... *C25D 11/20* (2013.01); *B24B 1/00* (2013.01); *C25D 11/06* (2013.01); *C25D 11/08* (2013.01);
(Continued)

(58) Field of Classification Search
CPC . C25D 5/44; C25D 5/50; C25D 11/16; C25D 11/20; C25D 9/02; C25D 13/04; C25D 13/20
(Continued)

(56) References Cited

U.S. PATENT DOCUMENTS 3,158,457 A * 11/1964 Whitfield ..... B01D 46/12 454/187
6,322,689 B1 * 11/2001 Omasa ..... C25D 11/02 204/222
(Continued)

FOREIGN PATENT DOCUMENTS

CN 1460561 B 12/2003
CN 101270477 A 9/2006
(Continued)

OTHER PUBLICATIONS

Applicants' Admission, Specification: p. 10, lines 11-17 and p. 11, lines 8-14: CN 1460561.*
(Continued)

*Primary Examiner* — Edna Wong
(74) *Attorney, Agent, or Firm* — Innovation Capital Law Group, LLP; Vic Lin

(57) ABSTRACT

The invention discloses an anodization sealing process for an aluminum or aluminum alloy element for vehicles, including the steps for rinsing with pure water, electrolysis, rinsing once again, electrical deposition sealing, rinsing with pure water several times and baking. The aluminum or
(Continued)

aluminum alloy element for vehicles obtained thus has improved alkali resistance and erosion resistance.

6 Claims, 3 Drawing Sheets

(51) Int. Cl.

| | |
|---|---|
| ***C25D 5/34*** | (2006.01) |
| ***C25D 5/44*** | (2006.01) |
| ***C25D 5/50*** | (2006.01) |
| ***C25D 11/20*** | (2006.01) |
| ***C25D 11/16*** | (2006.01) |
| ***C25D 11/08*** | (2006.01) |
| ***B24B 1/00*** | (2006.01) |
| ***C25D 11/06*** | (2006.01) |
| ***C25F 3/20*** | (2006.01) |

(52) U.S. Cl.
CPC ..... *C25D 11/16* (2013.01); *C25D 11/18* (2013.01); *C25F 3/20* (2013.01)

(58) Field of Classification Search
USPC ..... 205/172, 206, 213, 219, 224, 324, 229, 205/317; 204/509, 510
See application file for complete search history.

(56) References Cited

U.S. PATENT DOCUMENTS

2003/0127338 A1* 7/2003 Beier-Korbmacher ..... C25D 11/08 205/229
2003/0201182 A1* 10/2003 Nakamura ..... B05D 7/14 204/484
2011/0214993 A1* 9/2011 Akana ..... C25D 5/00 205/50
2011/0311838 A1* 12/2011 Kawagoshi ..... C09D 5/448 428/626
2012/0024703 A1* 2/2012 Poole ..... C09D 5/4492 204/507

FOREIGN PATENT DOCUMENTS

CN 101225522 A * 7/2008 ..... C23G 1/14
CN 101619479 A 1/2010
CN 102268716 A 12/2011
CN 102797029 A * 11/2012 ..... C23F 3/20
CN 103194777 A 7/2013
CN 103352244 A 10/2013
CN 103469277 A 12/2013
DE 102013224748 A1 * 6/2014 ..... C25D 13/22
JP 2000-355795 A 12/2000
JP 2000355795 A * 12/2000 ..... C25D 11/22
JP 2005-36315 A 2/2005

OTHER PUBLICATIONS

Turner et al., "Anodized Architectural Aluminum Combined With an Organic Seal," In Proceedings of the Eighth International Aluminum Extrusion Technology Seminar, vol. II. Orlando:[sn] (no month, 2004), pp. 517-522.*
International Search Report for the Application No. PCT/CN2014/072770 dated Jun. 5, 2014.

* cited by examiner

ANODIZATION SEALING PROCESS FOR AN ALUMINUM OR ALUMINUM ALLOY ELEMENT FOR VEHICLES

BACKGROUND OF THE INVENTION

Field of Invention

The invention relates to an anodization sealing process for an aluminum or aluminum alloy element for vehicles.

Related Art

At present, high gloss, semigloss or satin-like gloss decorative or structural elements made from aluminum plates or aluminum profiles, are used inside or outside of many vehicles, which not only have a high ornamental effect but also have a protective effect. The highly ornamental surface of the elements is achieved through different pretreatment processes including mechanical polishing, abrasive blasting, drawing, electrolytic polishing and etching, before oxidization. In order to provide the highly ornamental surface with a good protective property, the anodized film has to be sealed after the anode is oxidized.

The conventional sealing process for an aluminum or aluminum alloy element for vehicles includes two steps. In other words, the anodized film will have a good erosion resistance through the cooperation of cold sealing with warm sealing. However, the aluminum or aluminum alloy elements made from this process could only be erosion resistant within the range of pH 1.5-11.5 or 1.5-12.5.

In Europe and the United States, the automatic vehicle cleaning device is more and more widely used. In such a device, alkali cleaning agent of pH 13.5 is used. As such, in the process of impregnation before cleaning, if the vehicle equipped with aluminum or aluminum alloy anodization members is subject to the cleaning agent, the vehicle will soon turn into a milky color and lose the aesthetic appearance. Such an impact will continue until the surface of the anode layer is completely impaired. Therefore, the alkali resistance of the anodization layer of the aluminum or aluminum alloy elements is to be improved to address the said problem.

For example, the Chinese Patent Application, the publication number of which is 101270477A, discloses a sol-gel coating disposed on the element subject to the aluminum anodization treatment, which makes the element resistant to environmental impacts and other loads. However, the sol-gel coating formed on the vehicle element could be only applied to special aluminum or aluminum alloy elements subject to aluminum anodization treatment, and is applied on the decorative strips by sparing, scrolling, impregnation, scraping and/or rolling, and then hardened by heating. Therefore, the metallic feel and appearance of the surface of the vehicle elements are poor, the production process thereof could not be controlled well and the cost is high.

SUMMARY OF THE INVENTION

In order to address the disadvantages existing the prior art, an object of the invention is to provide an anodization sealing process for an aluminum or aluminum alloy element for vehicles, to provide the aluminum or aluminum alloy element for vehicles with improved alkali resistance and erosion resistance.

The invention provides an anodization sealing process for an aluminum or aluminum alloy element for vehicles, characterized in that, the sealing process includes the following steps:

(S1) rinsing the anodized aluminum or aluminum alloy semi-finished product for vehicles with pure water under room temperature for 4~5 min, for which the pH value of the water after rinsing is controlled to be 3.0~7.0;

(S2) immersing the anodized aluminum or aluminum alloy semi-finished product rinsed with pure water of the step (S1) into the ammonium acetate solution having a pH value of 6.5~8.0 under room temperature, and electrolyzing the same by a single-phase alternating current of 10~15 V for 8~15 min under 25~30° C.;

(S3) rinsing the semi-finished product treated in the step (S2) by pure water for 4~5 min under room temperature, and controlling the pH value of the water after rinsing to be 5.0~7.0;

(S4) putting the semi-finished product thus rinsed in the step (S3) into the bath solution and performing electric deposition sealing with a gradient voltage on the semi-finished product according to a requirement of the element, forming an organic sealing film on the surface of the anodized film of the semi-finished product, for which the organic sealing film is made by mixing the acrylic resin with the amino resin;

(S5) rinsing the element electrically deposited with the organic sealing film of the step (S4) with pure water several times under room temperature until the remaining bath solution on the surface of the element is washed away, and controlling the pH value of the water after rinsing to be 8.0~9.0; and (S6) baking the washed element of the step (S5) under the temperature of 180~200° C. for 20~30 min.

The essence of the invention is to firstly form a layer of porous anodized film on the surface of the aluminum or aluminum alloy element, to decide whether to deposit any metallic salt within the pores of the porous anodized film based upon the requirement of different decorative surfaces so as to provide the element with a colored ornamental appearance, and then to electrically deposit a layer of highly ornamental organic film with excellent performance on the porous anodized film to sealing the film. The good performance and high ornamental nature of the film on the surface of the anodized element originates from the components, structure and special processing method of the film. As the main light absorption peak of the acrylic resin copolymerized by acrylate and methacrylate monomers is beyond the solar spectrum scope, the film thus made has excellent light resistance, color retention, hardness, chemical reagent resistance, water resistance and climate resistance. The aforesaid two resins are mixed in a proportion and cross linked and cured in a high-temperature environment with the effect of the additive to generate the high-quality film as desired.

The main purpose of the step (S1) is to clean the anodized aluminum or aluminum alloy semi-finished product, and dilute a main portion of sulfuric acid solution brought on the semi-finished product in the anodization and previous processes. Where the semi-finished product is rinsed for long enough, the sulfuric acid within the pores of the oxidized film will not be sufficiently diluted; and where the semi-finished product is overly rinsed, the oxidized film will be overly corroded. As acid is introduced into this cleaning process, the pH value will not increase. However, the sulfuric acid cleaning effect will be impaired where the pH value is too low.

The main purpose of the step (S2) is to adjust the components of the solution within the anodized film, to prevent or alleviate the impurity ions from the previous process, particularly sulfate ion, polluting the bath solution used in the subsequent process which may lead to poor appearance and performance of the sealing film. The bath solution for surface adjustment is made from mixing strong electrolyte ammonium acetate with pure water and lowering the pH value to a determined scope by using acetic acid or ammonia. The position of the strong electrolyte ammonium acetate will exchange with that of the sulfate ion within pores of the oxidized film through electromigration with the effect of the reverse electric filed, i.e, alternating current or reverse direct current with respect to oxidization, in operation, so that the sulfate ion within pores of the oxidized film will be removed. The present invention applies the electrolytic surface adjustment process instead of the original hot pure water rinsing process, which not only provides a better effect to remove sulfuric acid within pores of the anodized film than hot pure water rinsing, but also effectively prevents the pores of the anodized film from being sealed and the oxidized film from breaking in the cure process.

The main purpose of the step (S3) is to continue cleaning the semi-finished product, to prevent the impurities entering into the bath solution for the subsequent process. Where the semi-finished product is rinsed for long enough, the element will not be sufficiently cleaned, and where the semi-finished product is overly rinsed, the production efficiency will be impaired. To this end, the rinse duration is set to be 4~5 min. If the pH value is too low, the cleaning effect will be influenced and the impurities tend to be brought to the next process.

The electric deposition sealing in the step (S4) has a decisive effect upon the appearance and performance of the element eventually made. The charged resin particles reach a reverse electrode with the effect of DC electric filed. The paint film is separated by discharging or acquiring electrons and deposited on the article to be coated. The reaction firstly occurs on parts where the density of the electric line of force is particularly high, for example on the edges, corners and tips of the article to be coated. Once the deposition starts, the article to be coated will have some insulation, and the electric deposition will move to parts where the density of the electric line of force is lower, until a completely uniform film made from a mixture of the acrylic resin with the amino resin is formed. In other words, the organic sealing film is electrically deposited. While the film is formed, the solvent, diluent and a part of auxiliary agents are volatized, and the remaining components are involatile matters in the paints, i.e., the solid components, including resin, pigments and fillers. Therefore, the solid components are also called involatile contents. The higher the percent of the solid components in the paint is, the thickness of the film formed once in painting is larger. However, where the percent of the solid components is too low, the film will be thinner and pinholes tend to be formed; and where the percent of the solid components is too high, the disadvantages including wrinkles and high roughness tend to occur. The pH value, temperature and conductivity of the bath solution play a critical effect on formation of the film. Where the pH value is too low, the bath solution will be muddy resulting that the sealing film is rough and could not be formed; and where the pH value is too high, the film will be resolved once again and become thinner, resulting in defects including pinholes. As the temperature of the bath solution tends to be increased because of the heat generated in the electric deposition sealing process, the temperature has to be controlled. Otherwise, the increase of temperature will accelerate the reaction speed in the bath solution and make the deposition film rough, which tend to generate wrinkles. Moreover, as the impurities are continuously brought from the previous process into the electric deposition sealing process, the conductivity of the bath solution tends to increase. As such, the conductivity of the bath solution has to be controlled. Otherwise, the increase of the conductivity will lead to defects including high roughness and wrinkles. In serious scenarios, the bath solution will be out of use. Consequently, various factors are taken into account. Particularly, the mass percent of the solid components in the bath solution for electric deposition sealing is controlled to be 8~10%, and the bath solution has a pH value of 8.0~8.6, a temperature of 20~23° C. and a conductivity of 550~950 μs/cm.

Moreover, the conventional voltage control method refers to soft start and constant voltage control. The voltage is increased by the rectifier from 0 V to a set voltage in a preset soft start duration after the electric deposition voltage and time is set, and then constant voltage operation is performed according to a set duration. Such a control mode could ensure certain deposition efficiency and acquire better appearance. However, the uniformity of the film is difficult to be guaranteed when the thickness of the film is lower. Therefore, it takes more than two phases for the rectifier to reach the set voltage by using the gradient power supply program in the invention, in which each phase includes soft start and constant voltage control for automatic control by programming. The uniformity of the film could be guaranteed even when the film is thin by forming the film with the gradient voltage, so that the element still has good performance while its metallic feel is maintained.

The purpose of rinsing in the step (S5) is to wash away the remaining bath solution on the surface of the element, to prevent the surface of the element from curing and clotting.

The purpose of baking in the step (S6) is a critical process having an obvious effect on the performance and appearance of the element eventually produced. Where the baking temperature is too high, the film will become crispy and stress will be generated; and where the baking temperature is too low, the cure reaction will be insufficient and the performance of the film is impaired. Where the baking duration is too long, the film will tend to be crispy; and where the baking duration is too short, the cure reaction will be insufficient and the performance of the film is impaired. Therefore, the baking temperature for the anodization sealing process for the aluminum or aluminum alloy element for vehicles of the invention is controlled to be 180~200° C. and the baking duration is controlled to be 20~30 min. In addition, the dust-free level within the oven needs to be more than 10000. Otherwise, small sesame pots will be generated on the high gloss product.

The aluminum or aluminum alloy semi-finished product of the invention could be made by a conventional method or a following process:

(a) mechanical polishing—the surface of the aluminum or aluminum alloy semi-finished product is subject to grinding and cutting by using the cloth wheel and polishing wax, to make the surface of the aluminum or aluminum alloy semi-finished product flatter and brighter and thus obtain a higher ornamental nature;

(b) deoil—materials, including polishing wax, cutting oil and lubricating oil, attached to the surface of the aluminum or aluminum semi-finished product in the polishing and turnover processes are removed to provide the product with a clean surface, the mechanically polished aluminum or aluminum alloy semi-finished product is immersed into a deoil solution including sodium pyrophosphate 12~15 g/L, sodium phosphate 35~40 g/L, sodium carbonate 35~40 g/L, sodium dodecyl sulfate 10~12 g/L, sodium silicate 8~10 g/L and OP-10 2-3 g/L and processed for 5~8 min under 45~50° C.;

(c) water rinse—the deolied aluminum or aluminum alloy semi-finished product in the step (b) is rinsed by purer water for 4~5 min under room temperature and the conductivity of water after rinsing is controlled to be 10~60 μs/m;

(d) electrolytic polishing—the rinsed aluminum or aluminum alloy semi-finished product in the step (c) is put in the solution in which the concentration of phosphoric acid is 750~850 g/L, and that of aluminum ion is 35~40 g/L, and subject to electrolytic polishing under the temperature of 65~70° C. and current density of 8~10 A/dm2;

(e) water rinse—the electrolytically polished aluminum or aluminum alloy semi-finished product in the step (d) is rinsed by pure water for 4~5 min under room temperature, and the pH value of the water after rinsing is controlled to be 3.0~7.0;

(f) film removal—the rinsed aluminum or aluminum alloy semi-finished product in the step (e) is immersed into sodium hydroxide with temperature of 28~32° C. and concentration of 25~30 g/L for cleaning for 30~40 s;

(g) water rinse—the film-removed aluminum or aluminum alloy semi-finished product in the step (f) is rinsed by pure water for 4~5 min, and the conductivity of the water after rinsing twice is controlled to be 10~60 μs/m; and (h) anodization—the aluminum or aluminum alloy semi-finished product rinsed in the step (g) is immersed into the solution in which the concentration of phosphoric acid is 180 g/L and that of aluminum ion is 12 g/L, and the porous anodized film as desired is obtained through anodization for 20~30 min under the temperature of 17~18° C. and the voltage of 16 V to acquire the anodized aluminum or aluminum alloy semi-finished product.

The water rinse steps of the aforesaid anodization process are similar to each other, in which the remaining solution on the surface of the semi-finished product is to be washed away, preventing the same from being led into the bath solution for the next process or impairing the appearance and performance of the product. The main purpose for the deoil step is to remove the cutting solution, lubricating oil, polishing wax and the like attached to the semi-finished product in previous processes including machining and polishing, so that the product is provided with a clean surface to facilitate subsequent processing. The electrolytic polishing step could enhance brightness and flatness of the semi-finished product. A fine surface having a surface gloss more than 800 (60°) could be obtained by using the said formula in cooperation with six-series aluminum alloy in which the iron content is less than 0.04%, so than an extremely high ornamental surface could be acquired. The film removal step could remove the oxidized film which is formed on the surface of the semi-finished product after electrolytic polishing, which creates conditions to subsequently form a purer and high-quality oxidized film. The purpose of the anodization step is to react the semi-finished product used as the anode with the oxygen generated through electrolysis by way of the electrolytic effect of the direct current, to form a layer of densely porous aluminium oxide film.

In the anodization sealing process for the aluminum or aluminum alloy element for vehicles, the mass concentration of the ammonium acetate in the step (S2) is 0.5~2 g/L in a preferred embodiment.

In the anodization sealing process for the aluminum or aluminum alloy element for vehicles, the conductivity of the water in the step (S3) is controlled to be 8~60 μs/m in a preferred embodiment.

In the anodization sealing process for the aluminum or aluminum alloy element for vehicles, the mass percent of the solid components in the bath solution for electric deposition sealing of the step (S4) is 8~10%, and the bath solution has a pH value of 8.0~8.6, a temperature of 20~23° C., and a conductivity of 550~950 μs/cm in a preferred embodiment.

On one hand, when the element is required to have a high gloss surface, in the step (S4) for electric deposition sealing, the mass percent of the solid components in the bath solution is 8~9%, the bath solution has a pH value of 8.0~8.5, a temperature of 20~23° C., and a conductivity of 550~770 μs/cm, and the gradient voltage is turned on for 60~100 s under 60~80 V, and for 60~100 s under 100~120 V. More preferably, the gradient voltage is provided in which it takes 30 s for the voltage to increase from 0 V to 60~80 V, the voltage is kept at 60~80 V for 50 s, it takes 30 s for the voltage to increase to 100~120 V and the voltage is kept at 100~120 V for 50 s.

When the element is required to have a high gloss surface, the thickness of the organic sealing film formed by electric deposition sealing is 0.5~15 μm. When the element is required to have a high gloss surface, if the thickness of the electrically deposited organic sealing film thus formed is higher than 5 μm, the metallic feel of the element becomes poor and the quality of the element is significantly affected. More preferably, when the element is required to have a high gloss surface, the thickness of the organic sealing film formed by electric deposition sealing is 2~5 μm.

When the element is required to have a high gloss surface, the aluminum material selected is one or more of EN AW 6401, EN AW 5505, EN AW 5210 and EN AW 5310, which is subject to electric deposition sealing to obtain a high gloss ornamental piece.

When the element is required to have a high gloss surface, the ELECRON AG-210 paint available from Kansai Paint Co., Ltd could be used as the bath solution for electric deposition sealing. The paint is composed of the components in the following mass percent: acrylic resin of 16.5%, amino resin of 13.5%, solvent of 8.7%, neutralizing agent of 0.9%, additive of 0.01% and water of 60.4%. The specific components of the paint and the percent thereof could refer to the Chinese Invention Patent Publication CN1460561B.

On the other hand, when the element is required to have a semigloss surface, the mass percent of the solid components in the bath solution is 9~10%, the bath solution has a pH value of 8.3~8.6, a temperature of 20~23° C., and a conductivity of 650~950 μs/cm, and the gradient voltage is turned on for 60~100 s under 80~100 V, and for 60~100 s under 140~160 V. More preferably, the gradient voltage is provided in which it takes 30 s for the voltage to increase from 0 V to 80~100 V, the voltage is kept at 80~100 V for 50 s, it takes 30 s for the voltage to increase to 140~160 V and the voltage is kept at 140~160 V for 50 s.

When the element is required to have a semigloss surface, the thickness of the organic sealing film formed by electric deposition sealing is 3~25 μm. When the element is required to have a semigloss surface, if the thickness of the electrically deposited organic sealing film thus formed is smaller than 3 μm or larger than 25 μm, the semigloss surface could hardly be formed on the film and wrinkles will occur. More preferably, the thickness of the organic sealing film formed by electric deposition sealing is 10~15 μm.

When the element is required to have a semigloss surface, the aluminum material selected is one or more of EN AW 6063, EN AW 5005, EN AW 6060 and EN AW 6061, which is subject to electric deposition sealing to obtain a semigloss ornamental piece.

When the element is required to have a semigloss surface, the ELECRON AG-300 paint available from Kansai Paint Co., Ltd could be used as the bath solution for electric deposition sealing. The paint is composed of the components in the following mass percent: acrylic resin of 20.1%, amino resin of 13.4%, solvent of 17.0%, neutralizing agent of 0.6%, additive of 0.1% and water of 48.8%. The specific components of the paint and the percent thereof could refer to the Chinese Invention Patent Publication CN1460561B.

In the anodization sealing process for the aluminum or aluminum alloy element for vehicles, the process of rinsing several times in the step (S5) refers to rinsing with pure water twice, in which the element is first rinsed for 3~5 min and then rinsed for 5~8 min, and the conductivity of the water after rinsing is controlled to be 10~60 ρs/m in a preferred embodiment. In the event of continuous production, the pH value, the mass percent of the solid components and the conductivity all tend to increase. As such, the upper limit thereof shall be controlled to guarantee the cleaning effect required by the process of the invention. Meanwhile, the cleaning duration is also an important parameter to safeguard the cleaning effect. Where the cleaning duration is too short, the element could not be well cleaned; and where the cleaning duration is too long, the efficiency is impaired. Therefore, the element electrically deposited with an organic sealing film is rinsed by pure water twice, for which the element is first rinsed for 3~5 min and then rinsed for 5~8 min, and the conductivity of the water after rinsing is controlled to be 10~60 ρs/m.

In the anodization sealing process for the aluminum or aluminum alloy element for vehicles, a draining step is further provided between the step (S5) and the step (S6) in which the draining lasts 15~25 min at a temperature of 20~40° C. and in the dust-free room of a level higher than 10000. The draining process is a critical step which significantly influences the appearance of the product, particularly high gloss products. In the draining process, liquid containing chemical agents on the surface of the element sufficiently drops off by gravity, to prevent clotting on the surface of the element. Where the draining duration is not enough long, clotting might occur as the end is not sufficiently drained; and where the draining duration is too long, time will be wasted and efficiency will be degraded. Where the draining temperature is too low, the element could not be sufficiently drained and clotting tend to occur. Therefore, the draining duration shall be controlled to be 15~25 min, the training temperature shall be 20~40° C. and the level of the dust-free room shall be more than 10000.

Compared with the prior art, the invention has the following advantages.

First, in the sealing process of the invention, the electrolytic surface adjustment process is used instead of the conventional hot pure water rinse process before electric deposition sealing. As a result, not only the sulfuric aid within pores of the anodized film could be cleared in a better manner than the hot pure water rinse process, but also the pores of the anodized film could be efficiently prevented from being sealed in the hot pure water rinse process and the oxidized film could be prevented from breaking in the cure process.

Second, in the sealing process of the invention, the electric deposition mode is used as a production control means, which effectively guarantees uniformity of the sealing film and provides overall sealing treatment on the element.

Third, the sealing process of the invention could be of a mature industrial application, and used in connection with the conventional anodization production line, which will not produce industrial wastes and thus is an environment friendly process. The chemical agents and water for rinsing could be 100% recycled by using a recycle device.

Fourth, in the sealing process of the invention, different protective ornamental effects, including high gloss, semi-gloss and colored effects, can be provided according to the requirement of the element, which provides the oxidized film with a higher ornamental nature after sealing.

Fifth, in the sealing process of the invention, the rectifier control program using soft start and gradient voltage increase, i.e., gradient voltage, system is used instead of the conventional soft start and constant voltage control mode, which efficiently guarantees uniformity and continuity of the electrically deposited sealing film. Consequently, the element still has good erosion resistance while the film is thin.

Sixth, compared with the existing nickel salt sealing and hydro-thermal sealing technique, by using the sealing process of the invention, not only could the alkali resistance requirement for the anodization standard for aluminum or aluminum alloy element for vehicles be met, but also the heat resistance of the aluminum or aluminum alloy element for vehicles could be improved. Meanwhile, other performances verified in Natural Salt Spray test (NSS) and Copper-Accelerated Acetic Acid Salt Spray test (CASS) could be met.

Further scope of applicability of the present INVENTION will become apparent from the detailed description given hereinafter. However, it should be understood that the detailed description and specific examples, while indicating preferred embodiments of the INVENTION, are given by way of illustration only, since various changes and modifications within the spirit and scope of the INVENTION will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The technical solutions of the invention are further described with reference to the embodiments below. However, the invention is not limited to these embodiments.

Figure 1:
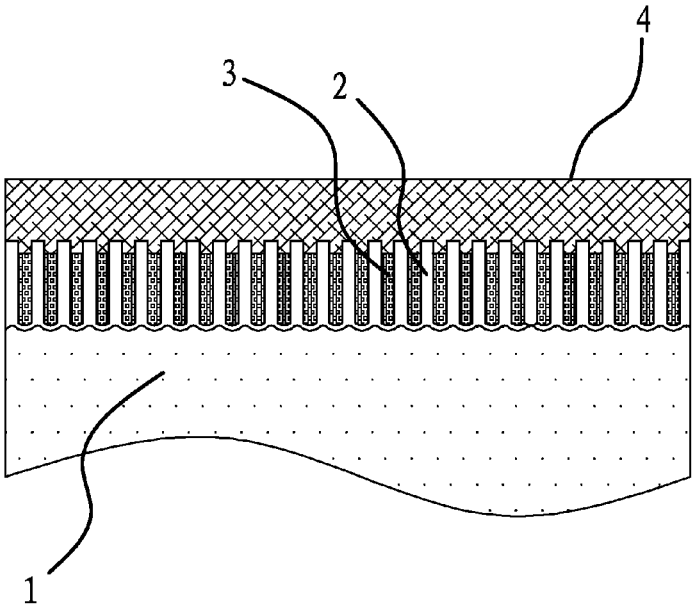
FIG. 1 is a section view of the aluminum or aluminum alloy element for vehicles made according to the third and fourth embodiments of the invention.

FIG. 1 shows a section view of the aluminum or aluminum alloy element for vehicles made from the process of the invention. The aluminum or aluminum alloy element for vehicles include inner, middle and outer layers, in which the inner layer is a substrate 1 made by aluminum or aluminum alloy materials; the outer layer is electrically deposited organic sealing film 4 made by mixing the acrylic resin with the amino resin; and the middle layer refers to an anodized film 2 and electrolytic colorization layers 3. The anodized film 2 is distributed between the inner layer and the outer layer to tightly engage with the substrate and the electrically deposited sealing layer. The electrolytic colorization layers 3 are filled in the small pores formed by the anodized film 2.

First Embodiment

The test sample is 40*100*2 mm, EN AW 6401 (extrusion profile).

The anodized aluminum or aluminum alloy semi-finished product for vehicles is sealed by the following sealing process. The aluminum or aluminum alloy semi-finished product is made from the following process in which the surface of the aluminum or aluminum alloy semi-finished product is subject to mechanical polishing treatment including grinding and cutting by using the cloth wheel and polishing wax; the mechanically polished aluminum or aluminum alloy semi-finished product is immersed into a deoil solution including sodium pyrophosphate 12 g/L, sodium phosphate 40 g/L, sodium carbonate 35 g/L, sodium dodecyl sulfate 12 g/L, sodium silicate 10 g/L and OP-10 2 g/L and processed for 8 min under 45° C.; the deolied aluminum or aluminum alloy semi-finished product is rinsed by purer water for 4 min under room temperature and the conductivity of water after rinsing is controlled to be 50 μs/m; the rinsed aluminum or aluminum alloy semi-finished product is put in the solution in which the concentration of phosphoric acid is 750 g/L, and that of aluminum ion is 40 g/L, and subject to electrolytic polishing under the temperature of 65° C. and current density of 8 A/dm$^2$; the electrolytically polished aluminum or aluminum alloy semi-finished product is rinsed by pure water for 4 min under room temperature, and the pH value of the water after rinsing is controlled to be 5.7; the rinsed aluminum or aluminum alloy semi-finished product is immersed into sodium hydroxide with temperature of 28° C. and concentration of 30 g/L for cleaning for 30 s; the film-removed aluminum or aluminum alloy semi-finished product is rinsed twice by pure water for 4 min, and the conductivity of the pure water after rinsing twice is controlled to be 50 μs/m; and the aluminum or aluminum alloy semi-finished product rinsed twice is immersed into the solution in which the concentration of phosphoric acid is 180 g/L and that of aluminum ion is 12 g/L, and the anodized aluminum or aluminum alloy semi-finished product is obtained through anodization for 20 min under the temperature of 17° C. and the voltage of 16 V.

The aluminum or aluminum alloy semi-finished product for vehicles is rinsed by pure water for 5 min under room temperature, and the pH value of the water after rinsing is 5.7 and the conductivity of the same is 15 μs/m.

The semi-finished product rinsed by pure water is immersed into the ammonium acetate solution having a pH value of 7.1 and a mass concentration of 1.2 g/L under room temperature, and is electrolysed by a single-phase alternating current of 14V for 10 min under 28° C.

The semi-finished product thus treated is rinsed by pure water for 5 min under room temperature, and the pH value of the water after rinsing is 5.7 and the conductivity of the same is 10 μs/m.

Figure 2:
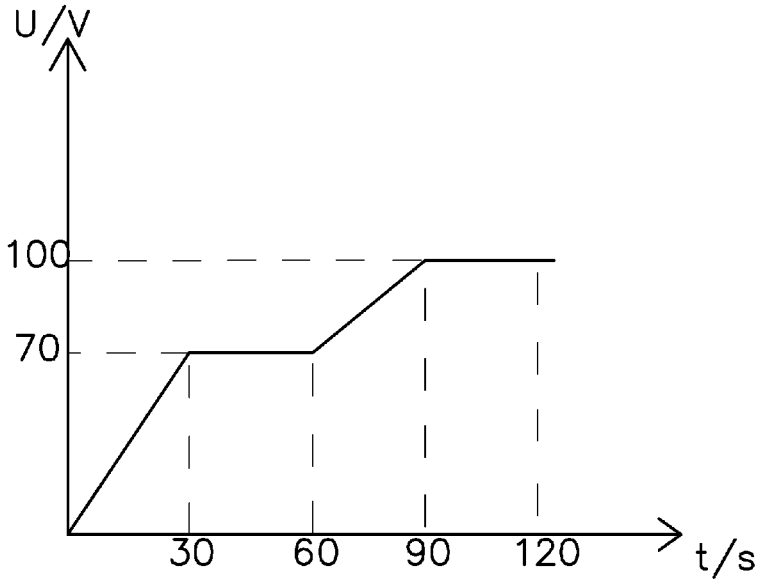
FIG. 2 is a line graph of the gradient voltage used by the first embodiment of the invention.
Figure 3:
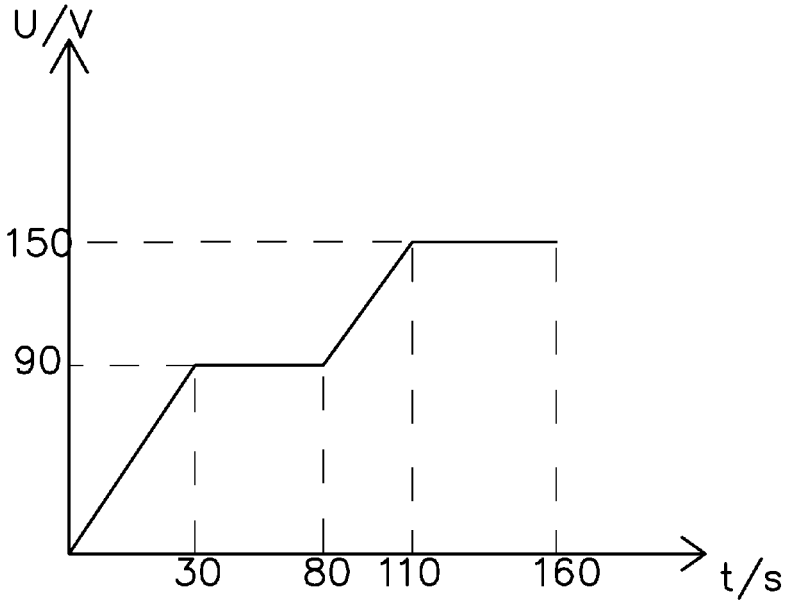
FIG. 3 is a line graph of the gradient voltage used by the second embodiment of the invention

The semi-finished product thus rinsed is put into the bath solution and subject to electric deposition sealing with a gradient voltage by using the ELECRON AG-210 paint available from Kansai Paint Co., Ltd. The mass percent of the solid components in the bath solution is 8.6%. The bath solution has a pH value of 8.3, an electric deposition temperature of 21.3° C., and a conductivity of 563 μs/cm. The line graph of the gradient voltage is shown in FIG. 2, in which it takes 30 s for the voltage to increase from 0 V to 70 V, the voltage is kept at 70 V for 30 s, and it takes 30 s for the voltage to increase to 100 V and then the voltage is kept at 100 V for 50 s.

The element electrically deposited with an organic sealing film is rinsed twice by pure water under room temperature, in which the element is first rinsed by pure water for 4 min, and the water after rinsing has a pH value of 8.3 and a conductivity of 13 μs/m; and the element is then rinsed by purse water for 6 min, and the water after rinsing has a pH value of 8.2 and a conductivity of 11 μs/m, until the remaining bath solution on the surface of the element is washed away.

The element rinsed twice is drained. The draining process is performed for 20 min under the temperature of 25.3° C. and in the dust-free room of a level higher than 10000.

The drained element is baked for 23 min under the temperature of 185~195° C., to obtain the aluminum or aluminum alloy element for vehicles electrically deposited with an organic sealing film.

The above described is the natural color oxidization and high gloss electric deposition sealing process and the sample thus obtained is numbered A.

Second Embodiment

The test sample is 40*100*2 mm, EN AW 6063 (extrusion profile).

The anodized aluminum or aluminum alloy semi-finished product for vehicles is sealed by the following sealing process. The anodized aluminum or aluminum alloy semi-finished product is made from the following process in which the surface of the aluminum or aluminum alloy semi-finished product is subject to mechanical polishing treatment including grinding and cutting by using the cloth wheel and polishing wax; the mechanically polished aluminum or aluminum alloy semi-finished product is immersed into a deoil solution including sodium pyrophosphate 14 g/L, sodium phosphate 38 g/L, sodium carbonate 36 g/L, sodium dodecyl sulfate 10 g/L, sodium silicate 9 g/L and OP-10 3 g/L and processed for 6 min under 45° C.; the deolied aluminum or aluminum alloy semi-finished product is rinsed by purer water for 4 min under room temperature and the conductivity of water after rinsing is controlled to be 40 μs/m; the rinsed aluminum or aluminum alloy semi-finished product is put in the solution in which the concentration of phosphoric acid is 800 g/L, and that of aluminum ion is 38 g/L, and subject to electrolytic polishing under the temperature of 70° C. and current density of 10 A/dm$^2$; the electrolytically polished aluminum or aluminum alloy semi-finished product is rinsed by pure water for 5 min under room temperature, and the pH value of the water after rinsing is controlled to be 6.0; the rinsed aluminum or aluminum alloy semi-finished product is immersed into sodium hydroxide with temperature of 30° C. and concentration of 28 g/L for cleaning for 35 s; the film-removed aluminum or aluminum alloy semi-finished product is rinsed twice by pure water for 5 min, and the conductivity of the pure water after rinsing twice is controlled to be under 40 μs/m; and the aluminum or aluminum alloy semi-finished product rinsed twice is immersed into the solution in which the concentration of phosphoric acid is 200 g/L and that of aluminum ion is 8 g/L, and the anodized aluminum or aluminum alloy semi-finished product for vehicles is obtained through anodization for 25 min under the temperature of 18° C. and the voltage of 16 V.

The aluminum or aluminum alloy semi-finished product for vehicles is rinsed by pure water for 5 min under room temperature, and the pH value of the water after rinsing is 5.7 and the conductivity of the same is 15 μs/m.

The semi-finished product rinsed by pure water is immersed into the ammonium acetate solution having a pH value of 7.1 and a mass concentration of 12 g/L under room temperature, and is electrolysed by a single-phase alternating current of 14 V for 10 min under 28° C.

The semi-finished product thus treated is rinsed by pure water for 5 min under room temperature, and the pH value of the pure water after rinsing is 5.7 and the conductivity of the same is 10 μs/m.

The semi-finished product thus rinsed is put into the bath solution and subject to electric deposition sealing with a gradient voltage by using the ELECRON AG-300 paints available from Kansai Paint Co., Ltd. The mass percent of the solid components in the bath solution is 9.5%. The bath solution has a pH value of 8.5, an electric deposition temperature of 22.4° C., and a conductivity of 723 μs/cm. The line graph of the gradient voltage is shown in FIG. 2, in which it takes 30 s for the voltage to increase from 0 V to 90 V, the voltage is kept at 90 V for 30 s, and it takes 30 s for the voltage to increase to 150 V and then the voltage is kept at 150 V for 50 s.

The element electrically deposited with an organic sealing film is rinsed twice by pure water under room temperature, in which the element is first rinsed by pure water for 4 min, and the water after rinsing has a pH value of 8.3 and a conductivity of 13 μs/m; and the element is then rinsed by purse water for 6 min, and the water after rinsing has a pH value of 8.2 and a conductivity of 11 μs/m, until the remaining bath solution on the surface of the element is washed away.

The element rinsed twice is drained. The draining process is performed for 20 min under the temperature of 25.3° C. and in the dust-free room of a level higher than 10000.

The drained element is baked for 23 min under the temperature of 185~195° C., to obtain the aluminum or aluminum alloy element for vehicles electrically deposited with an organic sealing film.

The above described is the natural color oxidization and semigloss electric deposition sealing process and the sample thus obtained is numbered B.

Third Embodiment

The test sample is 40*100*2 mm, EN AW 5210 (extrusion profile).

The anodized aluminum or aluminum alloy semi-finished product for vehicles is sealed by the following sealing process. The anodized aluminum or aluminum alloy semi-finished product for vehicles is made from the following process in which the surface of the aluminum or aluminum alloy semi-finished product is subject to mechanical polishing treatment including grinding and cutting by using the cloth wheel and polishing wax; the mechanically polished aluminum or aluminum alloy semi-finished product is immersed into a deoil solution including sodium pyrophosphate 15 g/L, sodium phosphate 35 g/L, sodium carbonate 40 g/L, sodium dodecyl sulfate 10 g/L, sodium silicate 8 g/L and OP-10 3 g/L and processed for 5 min under 50° C.; the deolied aluminum or aluminum alloy semi-finished product is rinsed by purer water for 5 min under room temperature and the conductivity of water after rinsing is controlled to be 30 μs/m; the rinsed aluminum or aluminum alloy semi-finished product is put in the solution in which the concentration of phosphoric acid is 850 g/L, and that of aluminum ion is 35 g/L, and subject to electrolytic polishing under the temperature of 70° C. and current density of 10 A/dm$^2$; the electrolytically polished aluminum or aluminum alloy semi-finished product is rinsed by pure water for 5 min under room temperature, and the pH value of the water after rinsing is controlled to be 5.0; the rinsed aluminum or aluminum alloy semi-finished product is immersed into sodium hydroxide with temperature of 32° C. and concentration of 25 g/L for cleaning for 40 s; the film-removed aluminum or aluminum alloy semi-finished product is rinsed twice by pure water for 5 min, and the conductivity of the pure water after rinsing twice is controlled to be 30 μs/m; and the aluminum or aluminum alloy semi-finished product rinsed twice is immersed into the solution in which the concentration of phosphoric acid is 200 g/L and that of aluminum ion is 5 g/L, and the anodized aluminum or aluminum alloy semi-finished product is obtained through anodization for 30 min under the temperature of 18 V and the voltage of 16 V.

The anodized aluminum or aluminum alloy semi-finished product for vehicles could be subject to a conventional electrolytic colorization process or electrolytically colorized by the following process. The anodized aluminum or aluminum alloy semi-finished product for vehicles is electrolysed in the sulfuric acid having a concentration of 20 g/L and the stannous sulfate having a concentration of 20 g/L under the temperature of 22° C. and the voltage of 14~16 V for 20 min until an electrolytic colorization layer is formed on the semi-finished product. The electrolytically colorized aluminum or aluminum alloy semi-finished product for vehicles is sealed by the following sealing process.

The aluminum or aluminum alloy semi-finished product for vehicles is rinsed by pure water for 5 min under room temperature, and the pH value of the water after rinsing is 6.0 and the conductivity of the same is 12 μs/m.

The semi-finished product rinsed by pure water is immersed into the ammonium acetate solution having a pH value of 7.3 and a mass concentration of 1.5 g/L under room temperature, and is electrolysed by a single-phase alternating current of 10 V for 10 min under 28° C.

The semi-finished product thus treated is rinsed by pure water for 5 min under room temperature, and the pH value of the pure water after rinsing is 5.8 and the conductivity of the same is 12 μs/m.

The semi-finished product thus rinsed is put into the bath solution and subject to electric deposition sealing with a gradient voltage by using the ELECRON AG-210 paint available from Kansai Paint Co., Ltd. The mass percent of the solid components in the bath solution is 8.6%. The bath solution has a pH value of 8.3, an electric deposition temperature of 21.3° C., and a conductivity of 563 μs/m. It takes 30 s for the gradient voltage to increase from 0 V to 60 V, the gradient voltage is kept at 60 V for 50 s, and it takes 30 s for the gradient voltage to increase to 100 V and then the gradient voltage is kept at 100 V for 50 s.

The element electrically deposited with an organic sealing film is rinsed twice by pure water under room temperature, in which the element is first rinsed by pure water for 4 min, and the water after rinsing has a pH value of 8.4 and a conductivity of 12 μs/m; and the element is then rinsed by purse water for 6 min, and the water after rinsing has a pH value of 8.3 and a conductivity of 10 μs/m, until the remaining bath solution on the surface of the element is washed away.

The element rinsed twice is drained. The draining process is performed for 20 min under the temperature of 25.3° C. and in the dust-free room of a level higher than 10000.

The drained element is baked for 23 min under the temperature of 185~195° C., to obtain the aluminum or aluminum alloy element for vehicles electrically deposited with an organic sealing film.

The above described is the natural color oxidization and high gloss electric deposition sealing process and the sample thus obtained is numbered C.

Fourth Embodiment

The test sample is 40*100*2 mm, EN AW 6060 (extrusion profile).

The anodized aluminum or aluminum alloy semi-finished product for vehicles is made from the same process as described in the second embodiment.

The anodized aluminum or aluminum alloy semi-finished product for vehicles could be subject to a conventional electrolytic colorization process or electrolytically colorized by the following process. The anodized aluminum or aluminum alloy semi-finished product for vehicles is electrolysed in the sulfuric acid having a concentration of 20 g/L and the stannous sulfate having a concentration of 20 g/L under the temperature of 22° C. and the voltage of 14~16 V for 20 min until an electrolytic colorization layer is formed on the semi-finished product. The electrolytically colorized aluminum or aluminum alloy semi-finished product for vehicles is sealed by the following sealing process.

The aluminum or aluminum alloy semi-finished product for vehicles is rinsed by pure water for 5 min under room temperature, and the pH value of the water after rinsing is 5.8 and the conductivity of the same is 13 μs/m.

The semi-finished product rinsed by pure water is immersed into the ammonium acetate solution having a pH value of 6.8 and a mass concentration of 1.0 g/L under room temperature, and is electrolysed by a single-phase alternating current of 12 V for 10 min under 28° C.

The semi-finished product thus treated is rinsed by pure water for 5 min under room temperature, and the pH value of the pure water after rinsing is 5.7 and the conductivity of the same is 9 μs/m.

The semi-finished product thus rinsed is put into the bath solution and subject to electric deposition sealing with a gradient voltage by using the ELECRON AG-300 paints available from Kansai Paint Co., Ltd. The mass percent of the solid components in the bath solution is 9.5%. The bath solution has a pH value of 8.5, an electric deposition temperature of 22.4° C., and a conductivity of 723 μs/cm. It takes 30 s for the gradient voltage to increase from 0 V to 100 V, the gradient voltage is kept at 100 V for 50 s, and it takes 30 s for the gradient voltage to increase to 160 V and then the gradient voltage is kept at 160 V for 50 s.

The element electrically deposited with an organic sealing film is rinsed twice by pure water under room temperature, in which the element is first rinsed by pure water for 4 min, and the water after rinsing has a pH value of 8.3 and a conductivity of 15 μs/m; and the element is then rinsed by purse water for 6 min, and the water after rinsing has a pH value of 8.1 and a conductivity of 13 μs/m, until the remaining bath solution on the surface of the element is washed away.

The element rinsed twice is drained. The draining process is performed for 20 min under the temperature of 25.3° C. and in the dust-free room of a level higher than 10000.

The drained element is baked for 23 min under the temperature of 185~195° C., to obtain the aluminum or aluminum alloy element for vehicles electrically deposited with an organic sealing film.

The above described is the natural color oxidization and semigloss electric deposition sealing process and the sample thus obtained is numbered D.

First Comparative Example

The test sample is 40*100*2 mm, EN AW 6401 (extrusion profile). The process for making the anodized aluminum or aluminum alloy semi-finished product for vehicles is the same as that described in the first embodiment and thus will not be described here.

An aluminum or aluminum alloy element electrically deposited with an organic sealing film is obtained by performing the following cold sealing and hot sealing processes on the anodized aluminum or aluminum alloy semi-finished product for vehicles. The A 609-A/-B cold sealing agent and Surtec 347 hot sealing agent available from SurTec International Gmbh are used as the sealing agent. With respect to the cold sealing, the temperature is 30° C., the pH value is 6.4, the sealing time is 8 min, the concentration of A 609-A cold sealing agent is 18 g/L and the concentration of A 609-B cold sealing agent is 6 g/L. With respect to the hot sealing, the temperature is 96° C., the pH value is 6.3, the sealing time is 25 min, and the concentration of Surtec 347 hot sealing agent is 3 g/L.

The above described is the natural color oxidization and conventional sealing process, and the sample thus obtain is numbered E.

Second Comparative Example

The test sample is 40*100*2 mm, EN AW 6401 (extrusion profile). The process for making the anodized aluminum or aluminum alloy semi-finished product for vehicles is the same as that described in the first embodiment and thus will not be described here.

The anodized aluminum or aluminum alloy semi-finished product for vehicles is sealed by the following sealing process.

The anodized aluminum or aluminum alloy semi-finished product for vehicles is rinsed by pure water for 5 min under room temperature, and the pH value of the water after rinsing is 5.7 and the conductivity of the same is 15 μs/m.

The semi-finished product rinsed by pure water is rinsed by hot water of the temperature of 75° C. for 5 min, and the pH value of the water after rinsing is 5.8 and the conductivity of the same is 12 μs/m.

The semi-finished product rinsed by the hot water is rinsed by pure water for 5 min, and the pH value of the water after rinsing is 5.7 and the conductivity of the same is 10 μs/m.

The semi-finished product thus rinsed is put into the bath solution and subject to electric deposition sealing by using the ELECRON AG-210 paint available from Kansai Paint Co., Ltd. The mass percent of the solid components in the bath solution is 8.6%. The bath solution has a pH value of 8.3, an electric deposition temperature of 21.3° C., and a conductivity of 563 μs/cm. The voltage of the electric deposition sealing is 110 V and the electric deposition time is 120 s.

The element electrically deposited with an organic sealing film is rinsed twice by pure water under room temperature, in which the element is first rinsed by pure water for 4 min, and the water after rinsing has a pH value of 8.3 and a conductivity of 13 μs/m; and the element is then rinsed by purse water for 6 min, and the water after rinsing has a pH value of 8.2 and a conductivity of 11 μs/m, until the remaining bath solution on the surface of the element is washed away.

The element rinsed twice is drained. The draining process is performed for 20 min under the temperature of 25.3° C. and in the dust-free room of a level higher than 10000.

The drained element is baked for 23 min under the temperature of 185~195° C., to obtain the aluminum or aluminum alloy element for vehicles electrically deposited with an organic sealing film.

The above described is the natural color oxidization and conventional high gloss electrophoresis sealing process and the sample thus obtained is numbered F.

Third Comparative Example

The test sample is 40*100*2 mm, EN AW 6063 (extrusion profile). The process for making the anodized aluminum or aluminum alloy semi-finished product for vehicles is the same as that described in the first embodiment and thus will not be described here.

The anodized aluminum or aluminum alloy semi-finished product for vehicles is sealed by the following sealing process.

The anodized aluminum or aluminum alloy semi-finished product for vehicles is rinsed by pure water for 5 min under room temperature, and the pH value of the water after rinsing is 5.7 and the conductivity of the same is 15 μs/m.

The semi-finished product rinsed by pure water is rinsed by hot water of the temperature of 75° C. for 5 min, and the pH value of the water after rinsing is 5.8 and the conductivity of the same is 12 μs/m.

The semi-finished product rinsed by the hot water is rinsed by pure water for 5 min, and the pH value of the water after rinsing is 5.7 and the conductivity of the same is 10 μs/m.

The semi-finished product thus rinsed is put into the bath solution and subject to electric deposition sealing by using the ELECRON AG-300 paints available from Kansai Paint Co., Ltd. The mass percent of the solid components in the bath solution is 9.5%. The bath solution has a pH value of 8.5, an electric deposition temperature of 22.4° C., and a conductivity of 723 μs/cm. The voltage of the electric deposition sealing is 150 V and the electric deposition time is 180 s.

The element electrically deposited with an organic sealing film is rinsed twice by pure water under room temperature, in which the element is first rinsed by pure water for 4 min, and the water after rinsing has a pH value of 8.3 and a conductivity of 13 μs/m; and the element is then rinsed by purse water for 6 min, and the water after rinsing has a pH value of 8.2 and a conductivity of 11 μs/m, until the remaining bath solution on the surface of the element is washed away.

The element rinsed twice is drained. The draining process is performed for 20 min under the temperature of 25.3° C. and in the dust-free room of a level higher than 10000.

The drained element is baked for 23 min under the temperature of 185~195° C., to obtain the aluminum or aluminum alloy element for vehicles electrically deposited with an organic sealing film.

The above described is the natural color oxidization and conventional semigloss electrophoresis sealing process and the sample thus obtained is numbered G.

In order to conduct a better comparative analysis upon the aluminum or aluminum alloy element for vehicles according to the first to fourth embodiments and the first to third comparative examples, a test verification is carried out in accordance with the strictest standard TL 182 of Volkswagen anodized parts in the current vehicle industry which was published in November 2012 and is applicable to some high-end automobiles of Volkswagen, including Audi R8, the result of which is shown in Table 1.

TABLE 1

| Test Project | | | | | |
|---|---|---|---|---|---|
| Serial No. | Experimental Project | Standard Title | Test Method | Test Requirements | Test Equipment |
| 1 | Neutral Salt Spray Test | DIN EN ISO 9227 | At 25 ± 2° C., NaCl Concentration of 50 ± 5 g/L, pH 6.5-7.2 | No change brought by erosion at the appearance | Salt Spray Test Box |
| 2 | Copper-Accelerated Acetic Acid Salt Spray Test | DIN EN ISO 9227 | At 25 ± 2° C., NaCl Concentration of 50 ± 5 g/L, pH 6.0-7.0, and then dissolved in $CuL_2 \cdot H_2O_2$ Concentration of 0.26 ± 0.02 g/L, 48 h | No change brought by erosion at the appearance | Salt Spray Test Box |
| 3 | Acid and Alkali Resistance Test | TL 182 | At 22~35° C., immersed in to solution of pH 1 for 10 min, rinsed in water and the dried, placed at 40° C. for one hour (cooling not permitted, and next-step test is continued), immersed into the solution of pH 13.5, rinsed in water and then dried | No change of the appearance compared with its initial state | N/A |
| 4 | Temperature Resistance | TL 182 | Placed at 160° C. for 24 hours | No Crack, No change of the appearance compared with its initial state | High-Temperature Test Box |
| 5 | Climate Resistance | PV 3930 | Test in hot and humid environment (Florida Exposure Test) for a 2-year period | No visible change of the appearance compared with its initial state | N/A |

TABLE 2

Performance Test Result of Aluminum or Aluminum Alloy Element for Vehicles according to the First to Fourth Embodiments and the First to Third Comparative Examples

| Test Project | Sample Number | | | | | | |
|---|---|---|---|---|---|---|---|
| Serial No. | A | B | C | D | E | F | G |
| 1 | Q | Q | Q | Q | Q | Q | Q |
| 2 | Q | Q | Q | Q | U | U | U |
| 3 | Q | Q | Q | Q | U | Q | Q |

TABLE 2-continued

Performance Test Result of Aluminum or Aluminum Alloy Element for Vehicles according to the First to Fourth Embodiments and the First to Third Comparative Examples

| Test Project | Sample Number | | | | | | |
|---|---|---|---|---|---|---|---|
| Serial No. | A | B | C | D | E | F | G |
| 4 | Q | Q | Q | Q | U | Q | Q |
| 5 | Q | Q | Q | Q | Q | Q | Q |

Q—Qualified,
U—Unqualified

As depicted above, even though the element made by using the conventional anodization sealing process has good climate resistance, the element could generally not meet the requirements for 48-hour Copper-Accelerated Acetic Acid Salt Spray erosion resistance test, 24-hour 160° C. temperature resistance test as well as acid resistance and temperature maintenance and alkali resistance test The element made by using the conventional electrophoresis sealing process passes the alkali resistance and heat resistance tests, but tiny erosion points occur on the element after the CASS test for which the standard requirement could not met. On the other hand, the aluminum or aluminum alloy element for vehicles made by the sealing process of the invention could meet the requirements of all the tests, and present climate resistance obviously better than that made by the conventional electrophoresis sealing process.

The embodiments described herein are merely illustrative of the spirit of the invention. Those skilled in the art could make various alterations, supplements or alternatives to these embodiments without departing from the spirit of the invention or beyond the scope defined by the appended claims.

Even though a detailed description of the invention is made here with reference to some embodiments, various changes or amendments are obvious to those skilled in the art without departing from the spirit of the invention.

LIST OF REFERENCE NUMERALS

1 Substrate
2 Anodized Film
3 Electrolytic Colorization Layer
4 Electrically deposited Organic Sealing Film

The invention claimed is:

1. An anodization sealing process for an aluminum or aluminum alloy element for vehicles, characterized in that, the sealing process includes the following steps:

(S1) rinsing an anodized aluminum or aluminum alloy element for vehicles with water until pH value of water after rinsing is 3.0~7.0;

(S2) immersing the rinsed anodized aluminum or aluminum alloy element of the step (S1) into an ammonium acetate solution of which pH value is 6.5~8.0 and electrolyzing the element by a single-phase alternating current of 10~15 V for 8~15 min under 25~30° C.;

(S3) rinsing the element in the step (S2) with water until a pH value of water after rinsing is 5.0~7.0;

(S4) putting the element rinsed in the step (S3) into a bath solution and performing electric deposition sealing with a gradient voltage on the element, forming an organic sealing film on surface of the element, for which the organic sealing film is composed of acrylic resin and amino resin;

(S5) rinsing the element electrically deposited with the organic sealing film of the step (S4) with water several times until pH value of water after rinsing is 8.0~9.0, thus providing a washed element; and (S6) baking the washed element of the step (S5) under the temperature of 180~200° C. for 20~30 min;

wherein the element has either a high gloss surface or a semigloss surface, and when the element has the high gloss surface, mass percent of solid components in the bath solution for the electric deposition sealing of the step (S4) is 8~9%, and the bath solution has a pH value of 8.0~8.5, a temperature of 20~23° C., and a conductivity of 550~770 μs/cm, and the gradient voltage is provided by increasing voltage from 0 V to 60~80 V over 30 s and keeping the voltage at 60~80 V for 50 s, then increasing the voltage from 60~80 V to 100~120 V over 30 s, and keeping the voltage at 100~120 V for 50 s;

when the element has the semigloss surface, mass percent of solid components in the bath solution for the electric deposition sealing of the step (S4) is 9~10%, the bath solution has a pH value of 8.3~8.6, a temperature of 20~23° C., and a conductivity of 650~950 μs/cm, and the gradient voltage is provided by increasing voltage from 0 V to 80~100 V over 30 s and keeping the voltage at 80~100 V for 50 s, then increasing the voltage from 80~100 V to 140~160 V over 30 s and keeping the voltage at 150~160 V for 50 s.

2. The anodization sealing process as claimed in claim 1, characterized in that, the mass concentration of the ammonium acetate solution in the step (S2) is 0.5~2 g/L.

3. The anodization sealing process as claimed in claim 1, characterized in that, the conductivity of the water after rinsing in the step (S3) is controlled to be 8~60 μs/m.

4. The anodization sealing process as claimed in claim 1, characterized in that, when the element is required to have the high gloss surface, thickness of the organic sealing film formed by the electric deposition sealing is 2~5 μm.

5. The anodization sealing process as claimed in claim 1, characterized in that, when the element is required to have the semigloss surface, thickness of the organic sealing film formed by the electric deposition sealing is 10~15 μm.

6. The anodization sealing process as claimed in claim 1, characterized in that, a draining step is further provided between the step (S5) and the step (S6) in which the draining lasts 15~25 min at a temperature of 20~40° C. and a dust-free room of a level higher than 10000.

* * * * *